United States Patent [19]

Lowe, Jr.

[11] 4,184,699

[45] Jan. 22, 1980

[54] INTEGRAL PAGE AND TAB

[76] Inventor: Henry E. Lowe, Jr., River Glen Plz., 348 S. Columbia St., South Bend, Ind. 46601

[21] Appl. No.: 942,486

[22] Filed: Sep. 15, 1978

[51] Int. Cl.[2] ..... B42F 21/02

[52] U.S. Cl. ..... 281/41; 281/42; 283/38; 283/42

[58] Field of Search ..... 40/359, 360; 281/1, 281/3 R, 38–42; 283/1 R, 36–43, 56, 63 R

[56] References Cited

U.S. PATENT DOCUMENTS

| | | | |
|---|---|---|---|
| 803,709 | 11/1905 | Perrine | 283/1 R |
| 2,034,413 | 3/1936 | Ottinger | 281/42 |
| 2,300,623 | 11/1942 | Hornung | 40/360 |
| 2,941,819 | 6/1960 | Groody | 283/42 |
| 3,409,312 | 11/1968 | Wills | 281/42 |

FOREIGN PATENT DOCUMENTS

| | | | |
|---|---|---|---|
| 853899 | 10/1952 | Fed. Rep. of Germany | 283/40 |

*Primary Examiner*—John McQuade
*Attorney, Agent, or Firm*—Marmaduke A. Hobbs

[57] ABSTRACT

An integral page and tab for magazines, trade journals, catalogs, books and other publications, in which one or more pages include an outline of a pretab configuration which can be partially severed from the page and folded to form a tab projecting beyond the edge of the page, and which can be unfolded to permit the printed matter on the page to be read in the normal manner, without interference from the pretab configuration or from the tabs formed from the page. The tab formed on the pages may be located along the side or top or bottom edges, or at the corner or corners of the pages.

14 Claims, 14 Drawing Figures

INTEGRAL PAGE AND TAB

When someone reading or perusing magazines, trade journals, pamphlets, catalogs and similar publications, finds an item which he or she wants to mark for future reference or for someone else's attention, a common practice is to use a slip of paper as a marker, or to turn the corner of the page over and inwardly. Both of these two methods are usually unsatisfactory in that the slip of paper may not be available at the particular time when the marker is needed and may become displaced or lost, and turned over corners are inconspicuous after the publication has been closed and hence are frequently difficult to find. For a more permanent marker, a tab is occasionally glued to the edge of the page and permanently projects outwardly from the edge of the page. This type of tab is normally difficult and/or inconvenient to apply or attach to the edge of the page, and is impractical for periodicals and other publications which are normally discarded and destroyed after a few weeks.

Attempts have been made in the past to provide tabs which could be formed from the page by the reader, but these have been rather complicated and difficult to form and to use merely as a temporary marker. It is therefore one of the principal objects of the present invention to provide an integral page and tab in which the pages of a magazine or similar publication are formed essentially the same as conventional pages, with the exception that at least certain pages are perforated or otherwise lined in such a manner that a piece of the page can be partially severed and folded to form a tab along the edge of the page, preferably of a rectangular shape, and in which the tab so formed can be easily unfolded so that the printed material thereon can be reinserted in the context of the page.

Another object of the invention is to provide a page of the type used in magazines, trade journals, catalogs, books and similar publications, which is perforated in lines in one or more places to facilitate the formation of one or more tabs from the page, and in which the perforated lines do not interfere with the readability of the printed matter on the page.

Still another object of the invention is to provide magazines, trade journals, advance sheets and similar publications, in which one or more pages have an area or areas for forming marker tabs which, when partially severed from the page and folded, extend outwardly therefrom, when the publication is either opened or closed, and in which the preformed tab configuration can be along either the side and/or top and bottom edges of the pages and/or at the corners of the pages.

Additional objects and advantages of the present invention will become apparent from the following description and accompanying drawings, wherein.

Figure 7:
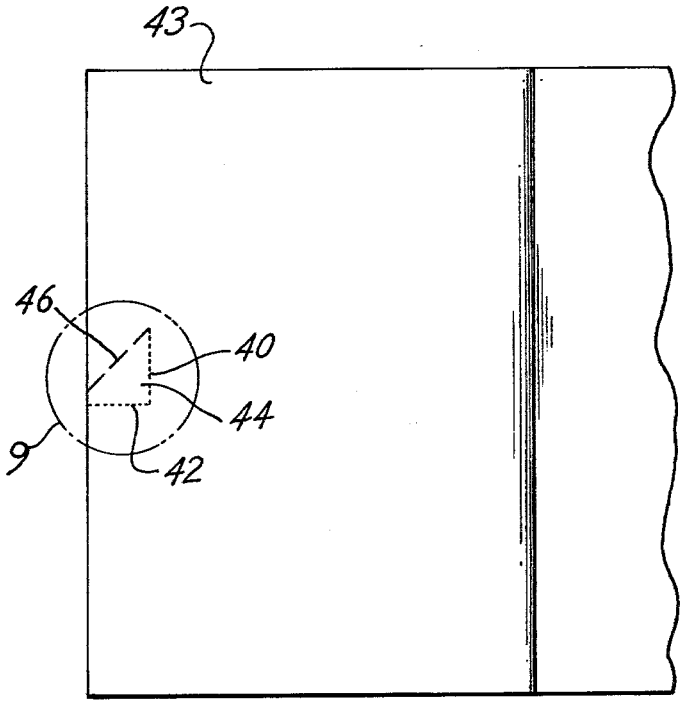
FIGS. 7 and 8 are plan views similar to FIG. 6, illustrating the formation of a tab in a different place along the page.
Figure 8:
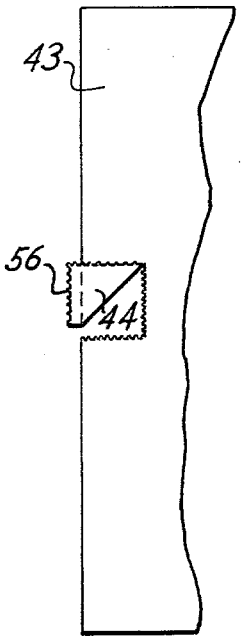
Figure 9:
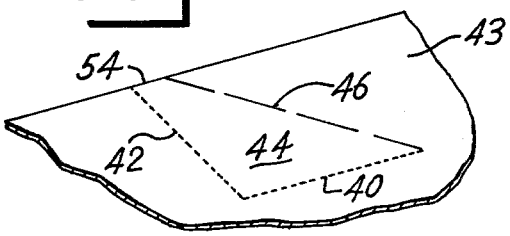
Figure 13:
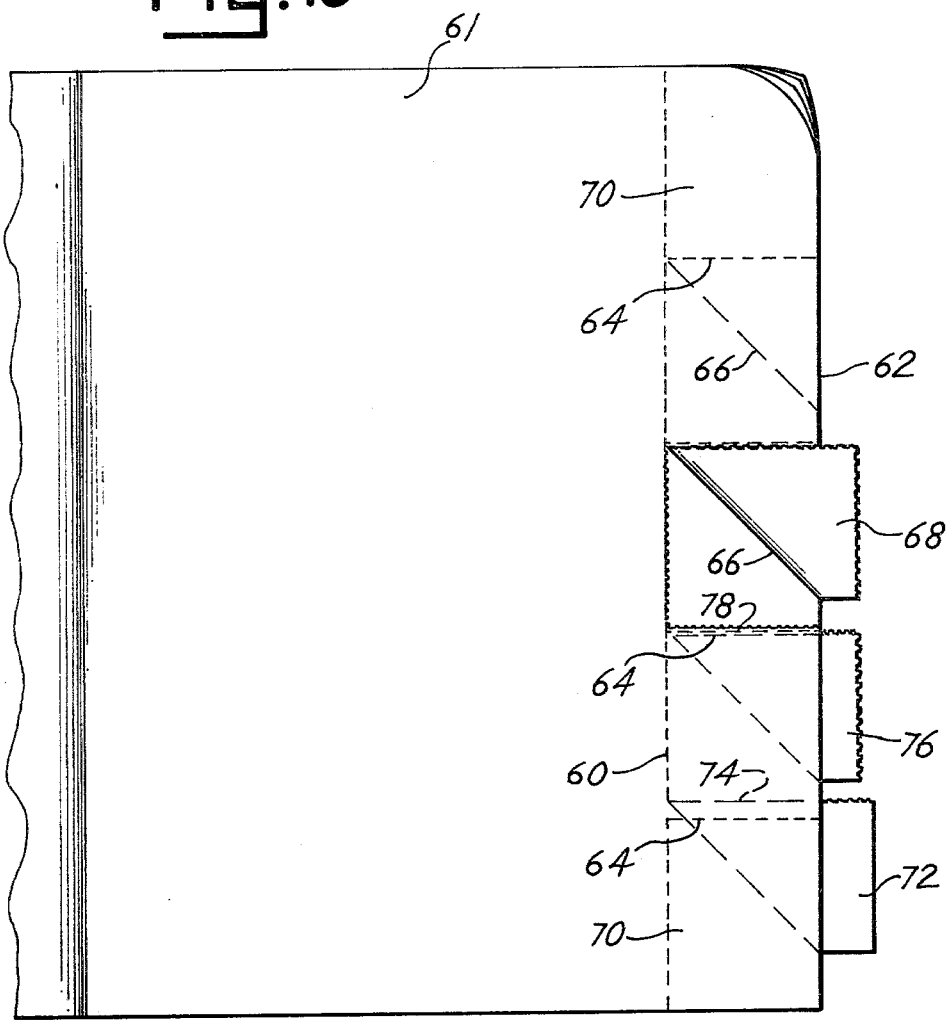
Figure 14:
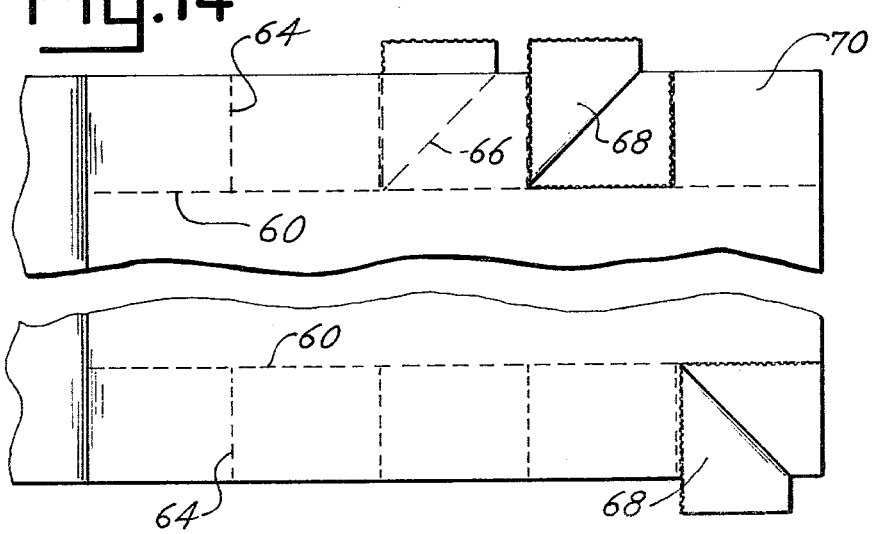

FIGS. 9, 10, 11 and 12 are fragmentary perspective views, illustrating the manner in which the integral tab of the type shown in FIGS. 7 and 8 is formed from the page; and FIGS. 13 and 14 are plan views illustrating two modified forms of the integral tab structure, showing a page for forming the tabs and several tabs formed from the pages in various locations at the edges of the pages.

The invention primarily involves the formation on a standard page of a magazine, trade journal or similar publication an outline by a perforated line or lines or by other indicia line, of a tab structure which can be partially severed from the page and folded along a line to form a tab projecting beyond the edge of the page, and which can be unfolded to permit the printed matter on the page to be read in the normal manner without interference from the tab or tabs formed from the page. The outline of the tab on the page normally includes one line spaced from and substantially parallel with the edge of the page from which the tab will project when partially severed from the page and folded into a tab form. The fold line for the tab has an included angle, preferably between 30 and 90 degrees, with respect to the severance line, so that when the partially separated tab structure is folded on the fold line a portion of the separated tab projects outwardly from the respective edge of the page to form a completed tab. A printed or perforated line may be made on the page to indicate the preferred place to fold the partially severed tab for a rectangular tab configuration, and indicia may be included to assist in severing the pretab form on the perforated line parallel to the edge of the page, to obtain tabs of various widths along the edge of the pages. The tab formed on the page may be located along the side or top or bottom edges and at the corners.

Figure 1:
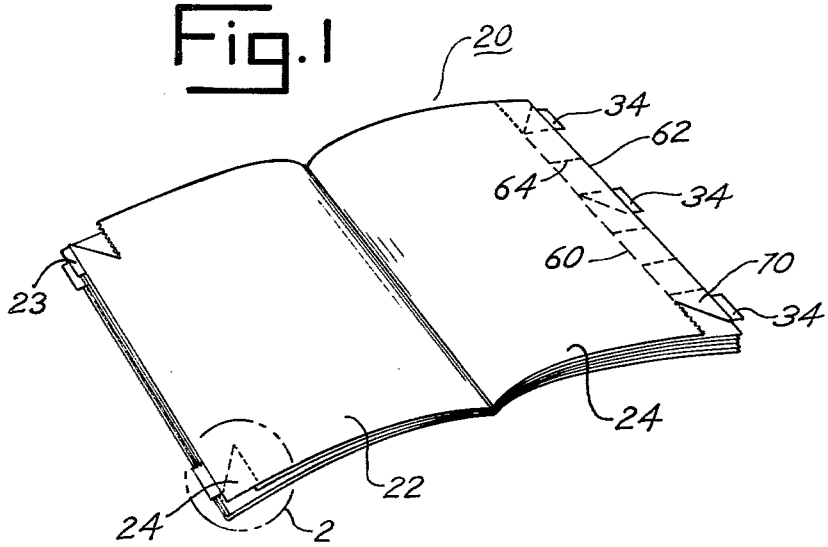
FIG. 1 is a perspective view of a magazine or similar publication showing the magazine open, with two pages illustrating the manner in which the pages are prepared for formation of the tabs and with several of the pages having integral tabs formed thereon.

Referring more specifically to the drawings and to FIG. 1 in particular, numeral 20 indicates generally a magazine, trade journal, catalog or similar publication, hereinafter referred to for convenience of description as a magazine, in which the magazine is open and a number of pages 22 are disposed on either side with integral tabs formed on a number of pages. The primary purpose of the tabs is to permit the reader to mark the magazine either for future reference himself, or for calling an item or article to the attention of someone else. The tabs formed from the pages extend beyond the edge of the pages and are preferably of a size sufficiently long and wide to permit notations to be made on the tabs for future reference. The present invention is applicable to various types of magazines and other publications, and is not limited to any particular type of paper or page size.

In all of the embodiments of the invention, the tab is formed in essentially the same manner, and the final tabs in the various modifications formed by the tab structure are normally the same configuration and structure. The magazine or trade journal, for example, is prepared and printed with pages having lines, perforated lines, to assist in partial separation of the tab from the page or sheet. The preferred manner is to provide perforations on the tear line so that the partial severance of the tab may be facilitated and guided by the perforations. Printed lines may be used if desired to indicate where the tear or cut is to be made and another line may be provided for indicating where the partially severed tab should be folded to form a final tab.

The pages may contain, for example, only one or two pretab formations, as shown on page 22, at numerals 23 and 24, or the page may have a series of pretab formations along the edge, thus permitting several separate tabs to be formed from the page to mark separate items or articles appearing on a particular page. This latter embodiment is best illustrated in FIGS. 13 and 14. This modification also permits the tabs for a particular page to be positioned at any desired location along the edge of the paper, thus permitting the tabs to form in effect an index from one page to another without significantly overlapping or concealing any other tabs. The perforations or other lines indicating where the separation of the tab should be made are placed on the pages either before or after printing, and the pretab portion can be printed along with the rest of the page.

Figure 2:
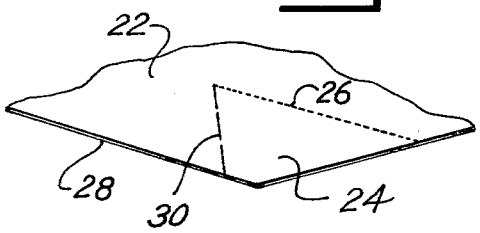
FIGS. 2, 3, 4 and 5 are fragmentary perspective views illustrating the steps for the formation of the tab at the corner identified by circle 2 in FIG. 1.
Figure 6:
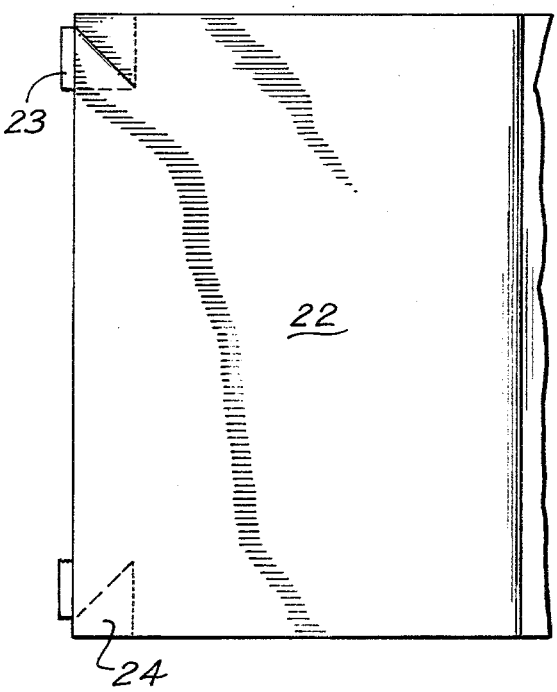
FIG. 6 is an enlarged top plan view of substantially one-half of the magazine shown in FIG. 1, illustrating the formation of the integral tab on several of the pages of the magazine.
Figure 3:
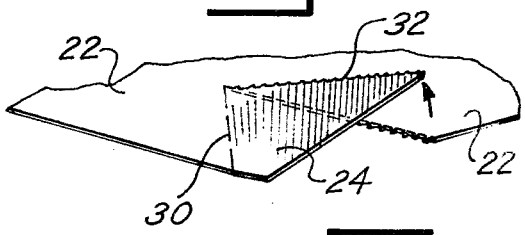
Figure 4:
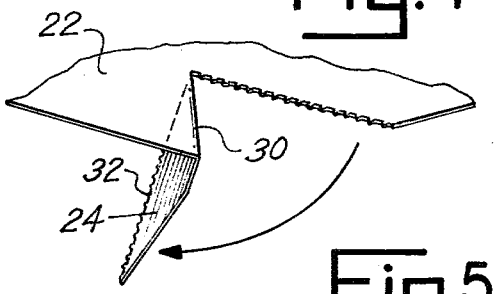
Figure 5:
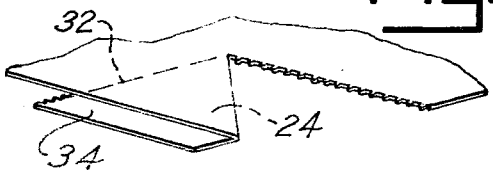

When the tab is formed in a particular location to mark the position of an item or article in a magazine, the fact that the tab is separated through the portion of the printed matter is usually of no significance, in that when the item or article is to be read, the tab can be folded back to its original position and, if desired, secured there by a small piece of transparent tape, thus virtually reconstructing the page in its original when the tab is no longer required or desired. In FIGS, 2 through 5, the steps for formation of a tab from a pretab configuration, identified by line 26 parallel to edge 28 of the page and diagonal line 30, preferably of 45° relative to line 26, are shown. FIG. 2 shows the page with the pretab perforations and fold line, and FIG. 3 illustrates partial separation of the tab from the page. After edge 32 of the tab has been separated from page 22, the separated tab is folded on line 30 in the manner illustrated in FIG. 4 with the folding taking place on line 30 and the tab being folded on the line to the underside of the page as illustrated in FIG. 5; however, the tab may be folded to either side of the page, i.e. upwardly or downwardly. After the tab has been folded in the manner illustrated in FIG. 5, the projecting tab portion 34 of a rectangular shape extends beyond the edge of the page to mark the desired page. Notations can be made on the projecting tab to indicate the purpose for marking the item or article.

Figure 10:
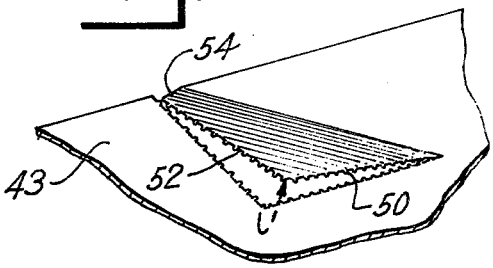
Figure 11:
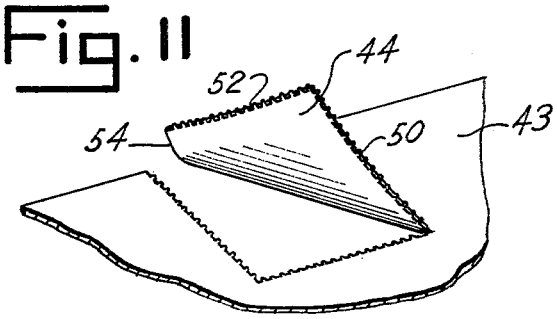
Figure 12:
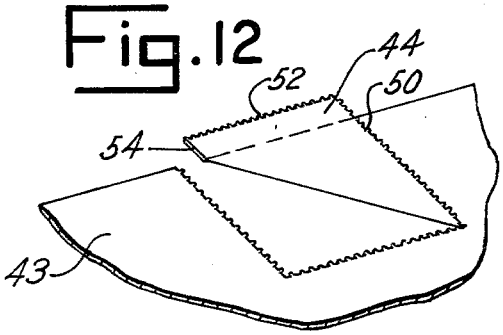

In the embodiments illustrated in FIGS. 7 through 12, the pretab perforated lines 40 and 42 are provided on page 43 for tab 44. When the tab is to be formed, the pages are torn along the lines 40 and 42 to separate the tab portion 44 therefrom, as illustrated in FIGS. 10 and 11, and the separated tab 44 is folded on line 46 from the position shown in FIGS. 10 and 11 to the position shown in FIG. 12. Severed edges 50 and 52 and edge 54 form tab 44, the first two edges being part of the page, in FIG. 9, along lines 40 and 42 before the lines are torn.

In FIG. 13 the pretab configuration consists of perforated line 60 extending the full length of page 61 spaced inwardly from edge 62, and a series of spaced perforated lines 64 at right angles to line 60. Lines 66 for folding the separated tab to the tab position to form tab 68 are also preferably included on the page. Any one of the rectangular sections 70 may be used to form a tab, thus permitting a number of tabs to be formed from any particular sheet, or to form the tabs from one sheet to the other in a spaced relation, as illustrated in FIG. 13, so that all the tabs can be easily seen when the magazine is closed. In formation of the tab, the line 60 may be severed at a length greater than or less than the space between the lines forming the rectangular section 70. Thus, it will be noted that tab 72 is formed with a severed edge 74 extending from line 60 above the adjacent line 64 to form a tab somewhat wider than tab 76 with severed edge 78 on the folded tab being substantially closer to the corresponding horizontal line than edge 74. When the pages containing these tabs are to be referred to or reread, the tabs can easily be folded back to their original position to permit the printed matter thereon to be easily seen and read with the rest of the material on the page.

The configuration of the pretab and the manner in which the tabs are formed are essentially the same in FIG. 14 as in FIG. 13, the only exception being that the pretab configurations and the position of the folded integral tabs are along the upper and/or bottom edges of the page. Hence, the same numerals are used to identify the corresponding parts of the pretab configuration and the tabs of FIG. 13. The manner in which the tabs are formed in the embodiment of FIG. 14 is also the same as that of the tabs in FIG. 13, and hence further description of these structures in FIG. 14 is unnecessary.

While several embodiments of the present integral page and tab have been described in detail herein, various additional modifications and embodiments may be made without departing from the scope of the invention.

I claim:

1. Integral page and tab for magazines, trade journals, catalogs, books and other publications, comprising a page having lines identifying a pretab configuration, including a first severance line spaced from and substantially parallel with one edge of said page for partially separating the tab structure from the page, and a fold line on which said partially separated tab structure is folded extending diagonally from said severance line to said one edge of the page, said fold line having an included angle with respect to said severance line so that when said partially separated tab structure is folded on said fold line a portion of said separated tab structure projects outwardly from said one edge of the page to form a completed tab.

2. Integral page and tab for magazines, trade journals, catalogs, books and other publications as defined in claim 1 in which said severance line consists of a series of perforations in the page.

3. Integral page and tab for magazines, trade journals, catalogs, books and other publications as defined in claim 1 in which a second severance line at substantially right angles to said first severance line and said one edge of the page, extends between said first line and said one edge.

4. Integral page and tab for magazines, trade journals, catalogs, books and other publications as defined in claim 3 in which said second severance line consists of a series of perforations in said page.

5. Integral page and tab for magazines, trade journals, catalogs, books and other publications as defined in claim 1 in which said first severance line starts at an edge of the page adjoining said one edge of said page and the tab formed thereby is adjacent the respective corner of the page.

6. Integral page and tab for magazines, trade journals, catalogs, books and other publications as defined in claim 2 in which said first severance line starts at an edge of the page adjoining said one edge of said page and the tab formed thereby is adjacent the respective corner of the page.

7. Integral page and tab for magazines, trade journals, catalogs, books and other publications as defined in claim 1 in which said first severance line extends from opposite edges of the page, and a plurality of second severance lines spaced from one another and from the opposite edges of the page, connect said first severance line with the edge of the page parallel to said first severance line.

8. Integral page and tab for magazines, trade journals, catalogs, books and other publications as defined in claim 7 in which said severance lines consist of a plurality of perforations.

9. Integral page and tab for magazines, trade journals, catalogs, books and other publications as defined in claim 7 in which said second severance lines are at right angles to said first severance line and consist of a series of perforations.

10. Integral page and tab for magazines, trade journals, catalogs, books and other publications as defined in claim 1 in which a partially separated tab structure is folded away from said severance line at substantially 45 degrees with respect to said one edge of the page.

11. Integral page and tab for magazines, trade journals, catalogs, books and other publications as defined in claim 7 in which a partially separated tab structure is folded away from said first severance line at substantially 45 degrees with respect to said one edge of the page.

12. Integral page and tab for magazines, trade journals, catalogs, books and other publications as defined in claim 1 in which a partially separated tab structure separated on said severance line is folded away from said first severance line at an included angle between 30 and 90 degrees therefrom.

13. Integral page and tab for magazines, trade journals, catalogs, books and other publications as defined in claim 7 in which a partially separated tab structure separated on said severance lines is folded away from said first severance line at an included angle between 30 and 90 degrees therefrom.

14. Integral page and tab for magazines, trade journals, catalogs, books and other publications as defined in claim 13 in which said second severance lines are at right angles to said one edge of the page and consist of a series of perforations.

* * * * *